US011542143B2

(12) United States Patent
Rue et al.

(10) Patent No.: US 11,542,143 B2
(45) Date of Patent: Jan. 3, 2023

(54) BEVERAGE DISPENSING NOZZLE WITH IN-NOZZLE MIXING

(71) Applicant: Accenture Global Solutions Limited, Dublin (IE)

(72) Inventors: Julia Rue, Mayaguez, PR (US); Lee Foster Powers, Arlington, MA (US); Michael Christopher Fox, Littleton, CA (US)

(73) Assignee: Accenture Global Solutions Limited, Dublin (IE)

( * ) Notice: Subject to any disclaimer, the term of this patent is extended or adjusted under 35 U.S.C. 154(b) by 0 days.

(21) Appl. No.: 17/449,146

(22) Filed: Sep. 28, 2021

(65) Prior Publication Data

US 2022/0106180 A1 Apr. 7, 2022

Related U.S. Application Data

(60) Provisional application No. 63/087,821, filed on Oct. 5, 2020.

(51) Int. Cl.
*B67D 1/00* (2006.01)

(52) U.S. Cl.
CPC ..... *B67D 1/005* (2013.01); *B67D 1/0036* (2013.01)

(58) Field of Classification Search
CPC ..... B67D 1/005; B67D 1/0036; B67D 2210/00104; B67D 1/0048; B67D 1/0857; B67D 1/0884; B67D 1/0888; B67D 1/0035
See application file for complete search history.

(56) References Cited

U.S. PATENT DOCUMENTS

| | | | | |
|---|---|---|---|---|
| 2,639,724 | A | 5/1953 | Cohen et al. | |
| 6,705,489 | B2 | 3/2004 | Henry et al. | |
| 10,252,900 | B2 | 4/2019 | Cook | |
| 2018/0223818 | A1 | 8/2018 | Vemula et al. | |
| 2019/0169011 | A1 | 6/2019 | Cook | |
| 2019/0248643 | A1* | 8/2019 | Kaplan | B67D 1/1405 |

FOREIGN PATENT DOCUMENTS

| | | |
|---|---|---|
| CA | 3045968 | 6/2018 |
| CN | 110312677 | 10/2019 |
| WO | WO 2018104810 | 6/2018 |

OTHER PUBLICATIONS

EP Extended Search Report in European Appln. No. 21200557.3, dated Feb. 16, 2022, 9 pages.

* cited by examiner

*Primary Examiner* — Donnell A Long
(74) *Attorney, Agent, or Firm* — Fish & Richardson P.C.

(57) ABSTRACT

A beverage dispensing system includes a nozzle assembly and a valve system, the nozzle assembly including a nozzle body having a diffuser chamber, a mixing chamber, and one or more cooling channels formed therein, a diffuser disposed within the diffuser chamber, and a manifold having one or more cooling channels formed therein and being configured to receive a flow of a base fluid and a flow of a concentrate for mixing of the base fluid and the concentrate in the mixing chamber to provide a beverage, and the valve system including one or more valves for regulating respective flow rates of each of the base fluid and the concentrate to substantially achieve a target mix ratio of the base fluid to concentrate within the mixing chamber.

20 Claims, 10 Drawing Sheets

BEVERAGE DISPENSING NOZZLE WITH IN-NOZZLE MIXING

CROSS-REFERENCE TO RELATED APPLICATION

This application claims priority to and the benefit of U.S. Prov. App. No. 63/087,821, entitled Beverage Dispensing Nozzle with In-nozzle Mixing, and filed on Oct. 5, 2020, the disclosure of which is expressly incorporated herein by reference in the entirety.

BACKGROUND

Dispensing systems have been developed for dispensing liquids, such as beverages. Different types of beverages have different characteristics and should be stored and dispensed in respective manners to achieve delivery of the beverage in a satisfactory manner. A satisfactory manner can include, for example and without limitation, serving the beverage at an appropriate temperature, at an appropriate pour, at an appropriate gas level (e.g., not over-carbonated, not under-carbonated (flat)) and a correct amount of head, such that the flavor, aroma, and visual presentation of the beverage is as intended.

Traditional beverage dispensing systems provide for storage of beverages and means for dispensing a beverage into a vessel. Some beverage dispensing systems reconstitute a beverage from base components (e.g., base fluid, gas, concentrate) on-demand. For example, some beverage dispensing systems are described as post-mix dispensers that mix a base fluid (e.g., gasified water) and concentrate (e.g., syrup) in a dispensing nozzle. However, and particularly in the case of reconstituting alcoholic beverages (e.g., beer), such post-mix beverage dispensing systems suffer from disadvantages, which can include, but are not limited to, dispensing beverages that do not meet a set of standards and otherwise fails to meet expectations in terms of, for example, quality and/or consumer satisfaction. As another example, some beverage dispensing systems are described as pre-mix dispensers that use so-called in-line mixing to reconstitute a beverage before reaching a dispensing nozzle. However, such pre-mix beverage dispensing systems also suffer from disadvantages, which can include, but are not limited to, a multitude of components, an overly complex assembly and operation of components, and, particularly in the case of reconstituting alcoholic beverages (e.g., beer), dispensing beverages that do not meet a set of standards or otherwise fails to meet expectations in terms of, for example, quality and/or consumer satisfaction.

SUMMARY

Implementations of the present disclosure are generally directed to a beverage dispensing system that includes a nozzle assembly with in-nozzle mixing of beverage components. More particularly, implementations of the present disclosure are directed to a beverage dispensing system that includes a nozzle assembly that is configured to mix a base fluid and a concentrate received by the nozzle assembly, and a valve system for adjusting respective flow rates of a base fluid and a concentrate that flow into the nozzle to achieve appropriate mixing and mix ratio within the nozzle. The beverage dispensing system of the present disclosure provides in-nozzle reconstitution (mixing of components) for dispensing a beverage that meets a set of standards.

In some implementations, a beverage dispensing system includes a nozzle assembly and a valve system, the nozzle assembly including a nozzle body having a diffuser chamber, a mixing chamber, and one or more cooling channels formed therein, a diffuser disposed within the diffuser chamber, and a manifold having one or more cooling channels formed therein and being configured to receive a flow of a base fluid and a flow of a concentrate for mixing of the base fluid and the concentrate in the mixing chamber to provide a beverage, and the valve system including one or more valves for regulating respective flow rates of each of the base fluid and the concentrate to substantially achieve a target mix ratio of the base fluid to concentrate within the mixing chamber.

These and other implementations can each optionally include one or more of the following features: at least one valve of the one or more valves is adjustable to adjust a mix ratio of the beverage to substantially achieve the target mix ratio; the diffuser is retained within the diffuser chamber by the manifold; at least a portion of the diffuser extends into the mixing chamber; the flow of concentrate travels through an interior of the diffuser and at least a portion of the flow of the base fluid travels around the diffuser for mixing of the base fluid and the concentrate substantially within the mixing chamber; the valve system includes an on/off valve for each of the concentrate and the base fluid; the target mix ratio is specific to the beverage dispensed from the dispensing system; the concentrate includes a beer concentrate and the base fluid comprises one of carbonated water and nitrogenated water; a concentrate source system includes a manifold that the concentrate flows through; and the concentrate is one of multiple concentrates that can selectively flow through the manifold within the concentrate source system.

It is appreciated that implementations of the present disclosure can include any combination of the aspects and features described herein. That is, implementations of the present disclosure are not limited to the combinations of aspects and features specifically described herein, but also may include any combination of the aspects and features provided.

The details of one or more implementations of the present disclosure are set forth in the accompanying drawings and the description below. Other features and advantages of the present disclosure will be apparent from the description, drawings, and claims.

BRIEF DESCRIPTION OF DRAWINGS

Like reference numbers and designations in the various drawings indicate like elements.

DETAILED DESCRIPTION

Figure 1A:
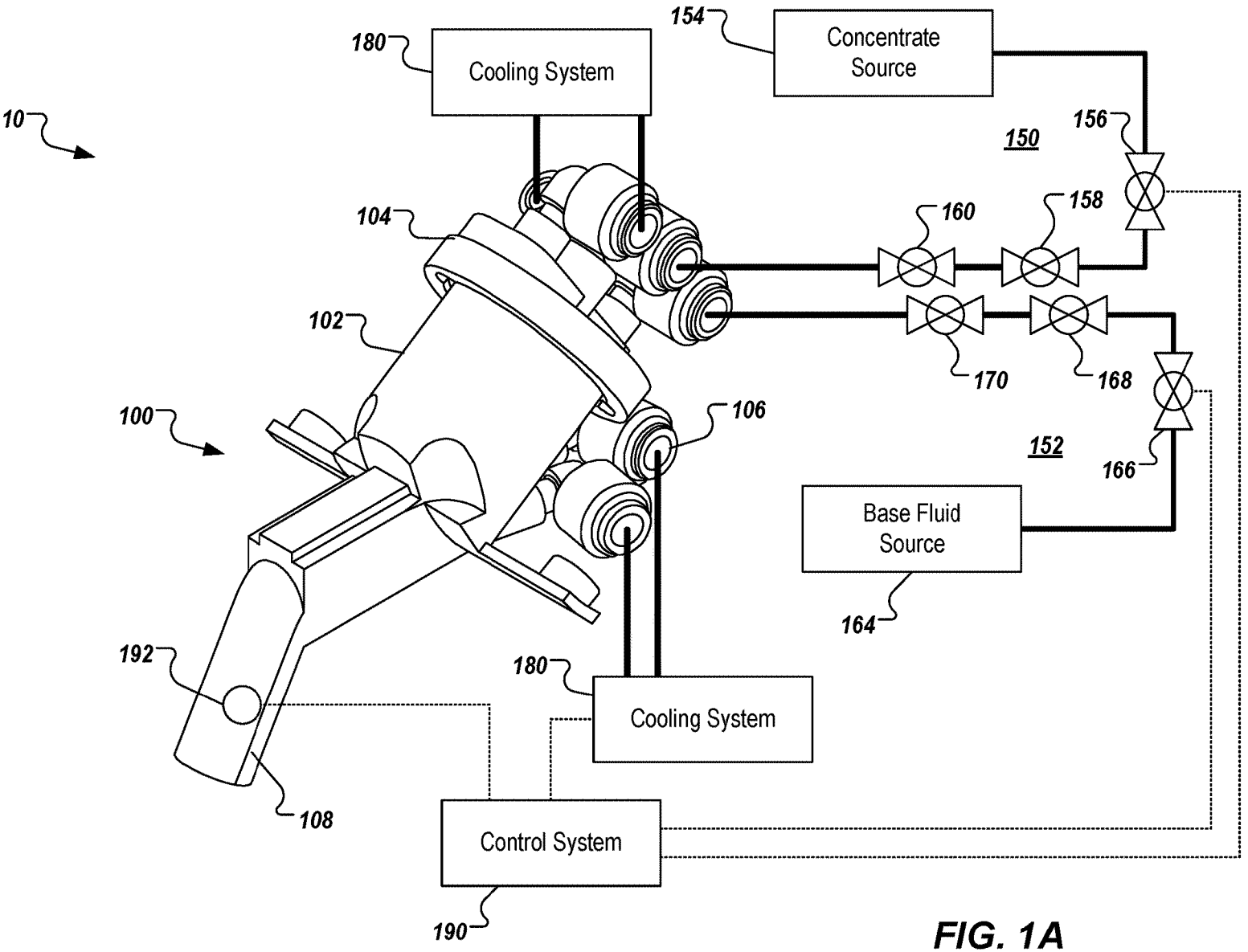
FIGS. 1A-1C depict a beverage dispensing nozzle assembly in accordance with implementations of the present disclosure.

Implementations of the present disclosure are generally directed to a beverage dispensing system that includes a nozzle assembly with in-nozzle mixing of beverage components. More particularly, implementations of the present disclosure are directed to a beverage dispensing system that includes a nozzle assembly that is configured to mix a base fluid and a concentrate received by the nozzle assembly, and a valve system for adjusting respective flow rates of a base fluid and a concentrate that flow into the nozzle to achieve appropriate mixing and mix ratio within the nozzle. The beverage dispensing system of the present disclosure provides in-nozzle reconstitution (mixing of components) for dispensing a beverage that meets a set of standards.

In some implementations, a beverage dispensing system includes a nozzle assembly and a valve system, the nozzle assembly including a nozzle body having a diffuser chamber, a mixing chamber, and one or more cooling channels formed therein, a diffuser disposed within the diffuser chamber, and a manifold having one or more cooling channels formed therein and being configured to receive a flow of a base fluid and a flow of a concentrate for mixing of the base fluid and the concentrate in the mixing chamber to provide a beverage, and the valve system including one or more valves for regulating respective flow rates of each of the base fluid and the concentrate to substantially achieve a target mix ratio of the base fluid to concentrate within the mixing chamber.

Implementations of the present disclosure are described in further detail with reference to an example beverage. The example beverage includes beer, of which there are various types. Example types of beer include, without limitation, lagers, light lagers, pale lagers, pilsners, dark lagers, American pales ales, Indian pale ales (IPAs), English pales ales, and stouts. It is contemplated, however, that implementations of the present disclosure can be realized for any appropriate beverage that can be reconstituted from a concentrate.

In the example context, different beers have different characteristics. The characteristics of a beer can affect the service of the beer. That is, the service of beer should meet a set of standards that are appropriate for the type of beer, such that the beer is served in a satisfactory manner. A satisfactory manner can include serving the beer at an appropriate temperature, at an appropriate pour, and a correct amount of head, such that the flavor, aroma, and visual presentation of the beer is as intended. With regard to temperature, for example, lagers and light lagers should be served in a range of 33-40° F., and preferably in a range of 36-38° F., pale lagers and pilsners should be served in a range of 38-45° F., and preferably in a range of 40-42° F., dark lagers and American pale ales should be served in a range of 45-50° F., and English pale ales should be served in a range of 50-55° F.

With regard to pour, pour parameters such as pour rate, angle and gas settings impact service of beer in a satisfactory manner. Target pour parameters can be different for different types of beers. For example, pouring a beer into a vessel (e.g., glass) at an angle mitigates turbulence in the pour and release of gases to achieve a target head (e.g., a layer of foam formed at the top of the beer). Achieving a target head releases the beer's aromatics and adds to the overall visual presentation and taste of the beer.

In general, beer is served as so-called draft beer from taps (also referred to as faucets) in a closed system. Because a draft beer system is a closed system, settings input to the system effect the resulting pours from the system. Correct setting of regulators (e.g., carbon dioxide ($CO_2$) gauges) will prevent both over- and under-carbonation (or nitrogen infusion). The setting can vary based on type of beer and/or how long the beer has been waiting to be served since tapped. For example, for ales (e.g., pale ales, IPAs, ambers) that have a carbonation volume in a range of 2.1 to 2.6, the regulator should be set within a range of about 7 to 13 PSI. For lagers, a range of 10 and 14 PSI is appropriate, while light pilsners require a range of 11 to 16 PSI. Wheat beers, Belgian beers, and common American sours are generally the most carbonated beers, requiring about 15 to 20 PSI. For stouts, nitrogen ($N_2$) is used, along with a stout faucet, and a nitrogen regulator should be set in a range of about 35 to 38 PSI.

In the example context, a beer can be reconstituted by mixing a base fluid (e.g., gasified water) and a concentrate (beer syrup). In some examples, the concentrate can itself be considered a high gravity beer (HGB) or an ultra-high gravity beer (UHGB). In general, the gravity of a beer refers to alcohol content in terms of alcohol-by-volume (ABV). In the case of beer, the concentrate can have an elevated alcohol content relative to the beer that is dispensed from a beverage dispensing system, referred to as the finished beer. In the case of the concentrate being a HGB, an example range for ABV can include 6%-15% ABV. In the case of the concentrate being an UHGB, an example range for ABV can include 15%-22% ABV. During reconstitution, which can also be referred to as de-brewing, the concentrate is mixed with the base fluid to provide a finished beer with a reduced ABV (e.g., in the range of about 4%-6% ABV).

In some examples, a set of standards can be provided and, if a beverage meets the set of standards, the beverage is considered to be served in a satisfactory manner. Example standards can include, without limitation, temperature, mix ratio, appearance (e.g., color, homogeneity, turbidity), ABV, and percent gas infusion. A design of a beverage dispensing system directly impacts whether a dispensed beverage meets a set of standards for the particular type of beverage (e.g., beer). For example, if the beverage dispensing system is appropriately designed, the temperature, mix ratio, appearance, etc. of the dispensed beverage should meet the set of standards.

As introduced above, and to provide context for implementations of the present disclosure, some beverage dispensing systems reconstitute a beverage from base components (e.g., base fluid, gas, concentrate) on-demand. For example, some beverage dispensing systems are described as post-mix dispensers that mix a base fluid (e.g., gasified water) and concentrate (e.g., syrup) in a dispensing nozzle. However, and particularly in the case of reconstituting alcoholic beverages (e.g., beer), such post-mix beverage dispensing systems suffer from disadvantages, which can include, but are not limited to, dispensing beverages that do not meet a set of standards or otherwise fails to meet expectations in terms of, for example, quality and/or consumer satisfaction. As another example, some beverage dispensing systems are described as pre-mix dispensers that use so-called in-line mixing to reconstitute a beverage before reaching a dispensing nozzle. However, such pre-mix beverage dispensing systems also suffer from disadvantages, which can include, but are not limited to, a multitude of components, an overly complex assembly and operation of components, and, particularly in the case of reconstituting alcoholic beverages (e.g., beer), dispensing beverages that do not meet a set of standards or otherwise fails to meet expectations in terms of, for example, quality and/or consumer satisfaction.

In view of this, and as described in further detail herein, implementations of the present disclosure are directed to a beverage dispensing system that is configured to mix a base fluid and a concentrate received by a beverage dispensing nozzle assembly. That is, the beverage dispensing nozzle assembly (also referred to as the nozzle herein) of the present disclosure provides for post-mixing, also referred to herein as in-nozzle mixing of components for dispensing a beverage that meets a set of standards. As described in further detail herein, the nozzle of the present disclosure includes, among other components, a set of integrated cooling lines for maintaining a temperature using fluid flow through the nozzle at (or substantially at) a target temperature. Further, implementations of the present disclosure include a valve system for adjusting respective flow rates of a base fluid and a concentrate that flow into the nozzle to achieve appropriate mixing and mix ratio within the nozzle. The beverage dispensing system achieves an appropriate mix ratio, temperature, gas infusion, ABV, and the like, to provide dispensing of beverages in a satisfactory manner that meets expectations of quality and customer satisfaction.

Figure 1B:
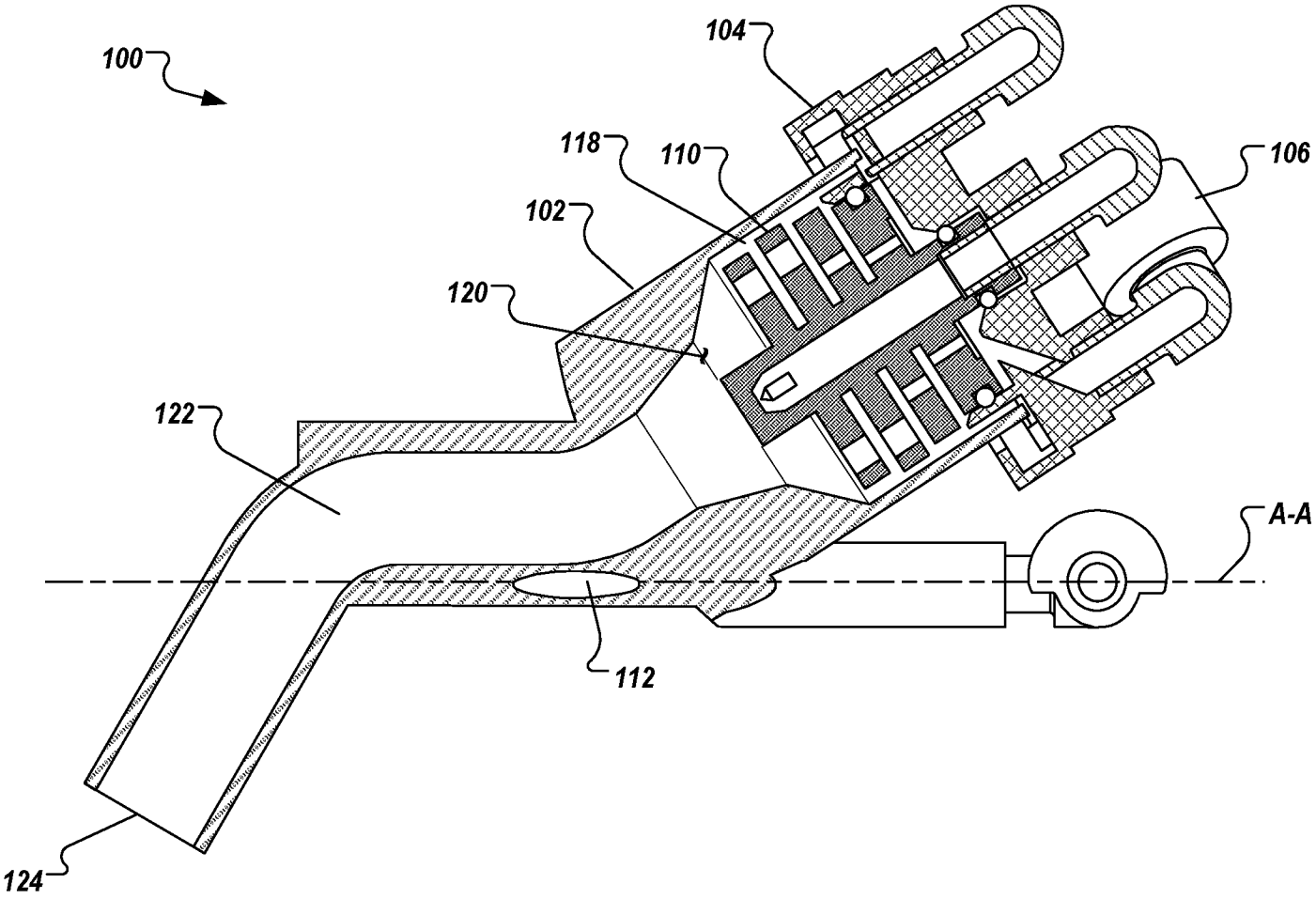
Figure 1C:
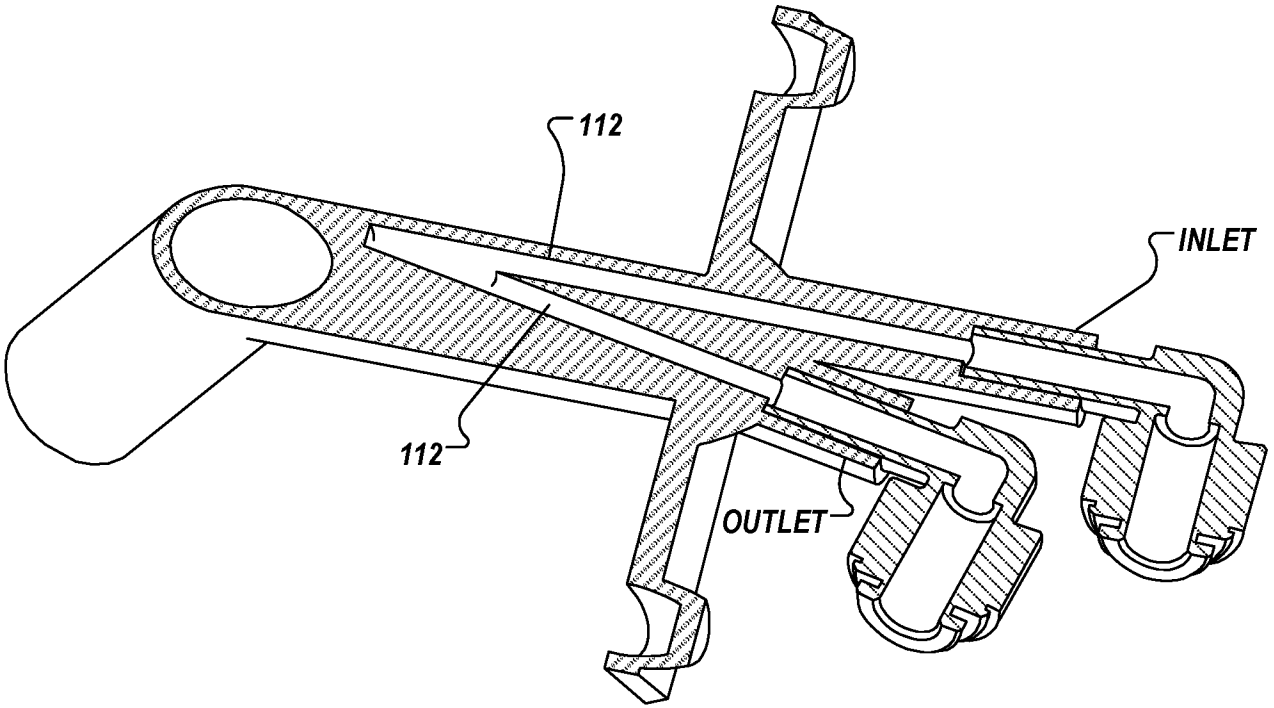

FIGS. 1A-1C depict a beverage dispensing nozzle assembly, also referred to herein as nozzle assembly or nozzle, 100 in accordance with implementations of the present disclosure. With particular reference to FIG. 1A, a beverage dispensing system 10 is depicted and includes the nozzle assembly 100. The nozzle assembly 100 includes a nozzle body 102 and a manifold 104. As described in further detail herein, fluids flow into and out of the nozzle assembly 100. To assist with this, one or more flow connectors 106 are provided. In the example of FIG. 1A, the nozzle body 102 forms a spout 108 toward an end, from which a beverage is dispensed.

FIG. 1B depicts a cross-sectional view of the nozzle assembly 100 generally along a centerline of the nozzle assembly 100. As depicted in FIG. 1B, the nozzle body 102 houses a diffuser 110, which is held in place in the nozzle body 102 by the manifold 104. As partially depicted in FIG. 1B, and as described in further detail herein, the nozzle body 102 also includes one or more cooling channels 112 defined therein. As also depicted in FIG. 1B, the nozzle body 102 defines a diffuser chamber 118, a mixing chamber 120, a dispensing channel 122, and an outlet 124. The diffuser chamber 118 is configured to receive the diffuser 110. As described in further detail herein, the manifold 104 is mountable to the nozzle body 102 to retain the diffuser 110 within the diffuser chamber 118 of the nozzle body 102.

FIG. 1C depicts a cross-sectional view of a portion of the nozzle assembly 100 revealing cooling channels 112 formed within the nozzle body 102. In the depicted example, two cooling channels 112 are formed in the nozzle body 102 and intersect. In this manner, the cooling channels 112 together form a cooling loop, such that cooling fluid (e.g., glycol) enters the nozzle body 102 through one of the cooling channels 112 and exits the nozzle body 102 from another of the cooling channels 112. Although an inlet and an outlet for cooling fluid are depicted in FIG. 1C, it is contemplated that these are interchangeable.

In accordance with implementations of the present disclosure, the cooling fluid flowing through the cooling channels 112 maintains each of the base fluid, the concentrate, and the (reconstituted) beverage at (or substantially at) a target temperature. As described above with example reference to beer, a target temperature for the beverage can depend on the type of the beverage. In some examples, a flow rate of the cooling fluid through the cooling channels 112 is controlled to achieve the target temperature.

Referring again to FIG. 1A, the beverage dispensing system 10 also includes a concentrate source system 150, a base fluid source system 152, and a cooling system 180. The concentrate source system 150 provides a flow of concentrate to the nozzle assembly 100 and the base fluid source system 152 provides a flow of base fluid to the nozzle assembly 100. The cooling system 180 provides a flow of cooling fluid (e.g., glycol) to each of the nozzle body 102 and the manifold 104. In some examples, the cooling system 180 can provide a flow of cooling flow to each of the concentrate source system 150 and the base fluid source system 152 to cool components and/or contents therein (e.g., fluid lines, valves, concentrate containers). It can be noted that fluid flow rates discussed herein can be provided in any appropriate units. Example units include, but are not limited to, $m^3/s$, $cm^3/s$, $mm^3/s$, L/s, cL/s, and mL/s. It is contemplated that the fluid flow rates are provided in the same units (e.g., all fluid flow rates are provided as cL/s).

In the example of FIG. 1A, the concentrate source system 150 includes a concentrate source 154, a first valve 156, a second valve 158, and a third valve 160 serially disposed along a fluid line. In some examples, the concentrate source 154 includes a reservoir of a concentrate (e.g., HGB, UHGB) and a pressure source to induce flow of the concentrate through the fluid line and the first valve 156, the second valve 158, and the third valve 160. In some examples, the concentrate flows from the concentrate source 154 at a first flow rate ($f_{con,1}$) to the first valve 156, from the first valve 156 at a second flow rate ($f_{con,2}$) to the second valve 158, from the second valve 158 at a third flow rate ($f_{con,3}$) to the third valve 160, and from the third valve 160 at a fourth flow rate ($f_{con,4}$) to the nozzle assembly 100. Although the first valve 156, the second valve 158, and the third valve 160 are depicted in FIG. 1A as individual valves, functionality of two or more of the first valve 156, the second valve 158, and the third valve 160 can be provided from a single valve assembly. For example, the valve assembly can receive a flow of concentrate at the first flow rate from the concentrate source 154 and can provide the flow of concentrate to the nozzle assembly 100 at the fourth flow rate.

In the example of FIG. 1A, the base fluid source system 150 includes a base fluid source 164, a first valve 166, a second valve 168, and a third valve 170 serially disposed along a fluid line. In some examples, the base fluid source 164 includes a reservoir of a base fluid (e.g., gasified liquid, such as carbonated water). In some examples, the base fluid source 164 provisions the base fluid from constituent fluids (e.g., water, gas). A flow of the base fluid is induced from the base fluid source 164 through the fluid line and the first valve 166, the second valve 168, and the third valve 170. In some examples, the base fluid flows from the base fluid source 164 at a first flow rate ($f_{base,1}$) to the first valve 166, from the first valve 166 at a second flow rate ($f_{base,2}$) to the second valve 168, from the second valve 168 at a third flow rate ($f_{base,3}$) to the third valve 170, and from the third valve 170 at a fourth flow rate ($f_{base,4}$) to the nozzle assembly 100.

In some implementations, the first valve 156 and the first valve 166 each function as initial flow control valves to tune the mix ratio of the concentrate to base fluid. For example, and as described herein, reconstitution of a beverage can require a particular mix ratio between the concentrate and the base fluid. Different beverages (or types of beverages) can have respective mix ratios. For example, a particular type of beer can require at target ratio of (or substantially of) 5-to-1 (5:1) base fluid to concentrate. The mix ratio is tuned based on the respective flow rates of the concentrate and the base fluid. Accordingly, the flow rate ratio of $f_{base,2}$ to $f_{con,2}$ ($f_{base,2}$:$f_{con,2}$) is the mix ratio. In the example of a mix ratio of 5:1, $f_{base,2}$ is five times $f_{con,2}$ (i.e., $f_{base,2}=5\times f_{con,2}$). Accordingly, the first valve 156 and the second valve 166 are tuned to adjust the flow rates of the respective fluid flows to substantially achieve the target mix ratio. In some examples, the target mix ratio is substantially achieved, if an actual mix ratio is equal to the target mix ratio. In some examples, the target mix ratio is substantially achieved, if a difference between the actual mix ratio and the target mix ratio is less than a threshold mix ratio difference.

In some implementations, each of the second valve 158 and the second valve 168 functions as an on/off valve. Accordingly, when the second valve 158 is (fully) open, $f_{con,3}$ is equal to $f_{con,2}$, and when the second valve 168 is (fully) open, $f_{base,3}$ is equal to $f_{base,2}$.

In some implementations, the third valve 160 and the third valve 170 are restrictor valves that slow the flow rates of the respective fluids, while maintaining the target mix ratio. In some examples, the flow rates are slowed by a predetermined percentage. An example percentage includes, but is not limited to, 20% (or substantially 20%). In this example, $f_{base,4}$ is 80% of $f_{base,3}$, and $f_{con,4}$ is 80% of $f_{con,3}$.

Although the first valve 166, the second valve 168, and the third valve 170 are depicted in FIG. 1A as individual valves, functionality of two or more of the first valve 166, the second valve 168, and the third valve 170 can be provided from a single valve assembly. For example, the valve assembly can receive a flow of base fluid at the first flow rate from the base fluid source 164 and can provide the flow of base fluid to the nozzle assembly 100 at the fourth flow rate.

In some examples, each of the concentrate source system 150 and the base fluid source system 152 is provided with cooling (e.g., by the cooling system 180) for maintaining each of the concentrate and the base fluid at (or substantially at) a target temperature. For example, fluid lines and valves of each of the concentrate source system 150 and the base fluid source system 152 are cooled to (or substantially to) the target temperature. In some implementations, fluid lines and valves are insulated.

In some implementations, the first valve 156 and/or the first valve 166 can be adjusted to tune the mix ratio of the concentrate to base fluid. For example, the first valve 156 and/or the first valve 166 can each be set to an initial setting to provide a target mix ratio for a type of beverage (e.g., a particular type of beer) that is to be dispensed from the nozzle assembly 100. It can be determined that the beverage as dispensed from the nozzle assembly 100 does not meet a set of standards. In response, the first valve 156 and/or the first valve 166 can each be set to an adjusted setting to provide an adjusted mix ratio. This process can be repeated until it is determined that the beverage as dispensed from the nozzle assembly 100 meets the set of standards.

In some implementations, the beverage dispensing system 10 includes a control system 190 and one or more sensors 192. In some examples, the one or more sensors 192 are each responsive to a parameter of the beverage as the beverage is dispensed from the nozzle assembly 100. Example parameters can include, without limitation, temperature, mix ratio, appearance (e.g., color, homogeneity, turbidity), ABV, and percent gas infusion. Each sensor 192 provides a signal based on a respective parameter and the signal is transmitted to the control system 190. In some examples, the control system 190 executes one or more computer-executable programs to process signals and determine actual values of each of the one or more parameters, and the actual values are compared to respective target values. In some examples, it can be determined whether an actual value is sufficiently at a target value. In some examples, an actual value is sufficiently at a target value, if it is equal to the target value. In some examples, an actual value is sufficiently at a target value, if a difference between the actual value and the target value is less than a threshold difference.

In some implementations, if an actual value of one or more parameters is not sufficiently at respective target values, the control system 190 can transmit control one or more control signals to one or more of the concentrate source system 150, the base fluid source system 152, and the cooling system 180. In some examples, a signal is generated based on a degree to which an actual value of a parameter differs from the target value of the parameter. A signal can be processed by one of the concentrate source system 150, the base fluid source system 152, and the cooling system 180, which can make an adjustment responsive to the signal. For example, if a signal indicates that the beverage is dispensed at a temperature that varies too much from a target temperature, the control system 190 can issue a signal to the cooling system 190 and, in response, the cooling system 190 can adjust cooling of one or more of the nozzle body 102, the manifold 104, the concentrate source system 150, and the base fluid source system 152. As another example, if a signal indicates that the beverage is dispensed at an ABV that varies too much from a target ABV, the control system 190 can issue a signal to the concentrate source system 150 and/or the base fluid source system 152 to adjust the mix ratio (e.g., adjust a setting of the first valve 156 and/or the first valve 166).

Figure 2B:
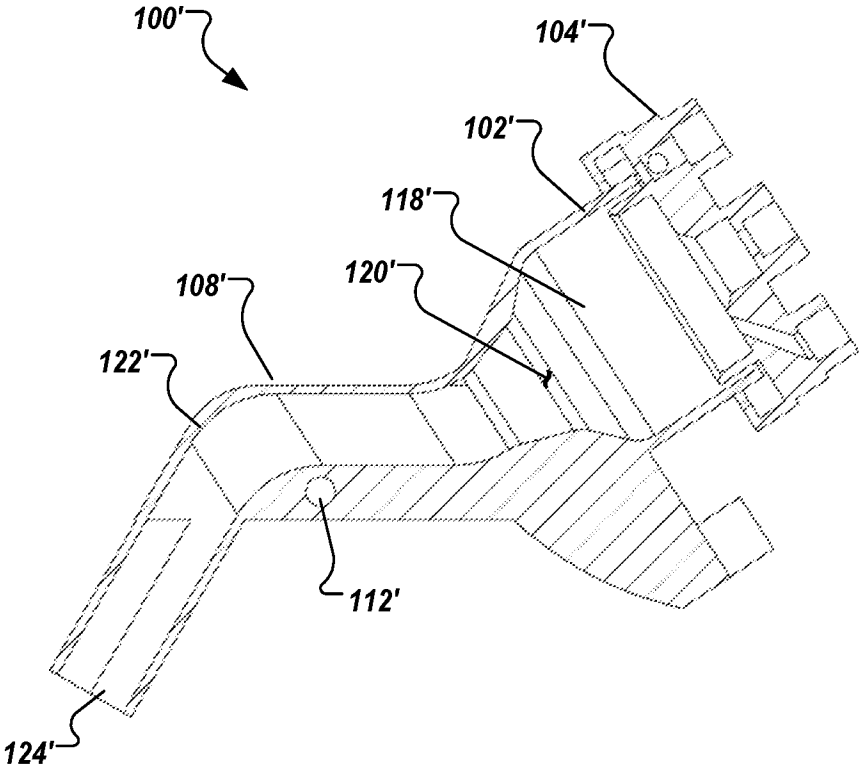
FIG. 2B depicts a cross-sectional view of the beverage dispensing nozzle assembly of FIG. 2A.
Figure 2A:
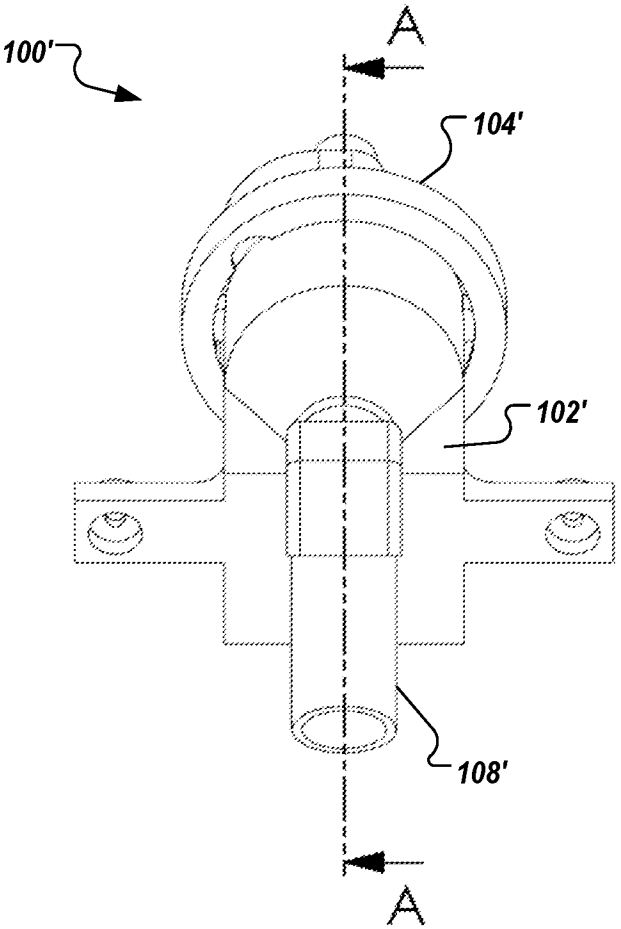
FIG. 2A depicts a front view of a beverage dispensing nozzle assembly in accordance with implementations of the present disclosure.

FIGS. 2A and 2B depict a portion of a beverage dispensing nozzle assembly 100' in accordance with implementations of the present disclosure. As discussed in further detail herein, FIGS. 2A and 2B depict a portion of the beverage dispensing nozzle assembly 100' in that a diffuser is absent depiction in FIG. 2B.

FIG. 2A depicts a front view of the portion of the beverage dispensing nozzle assembly 100'. In the example of FIG. 2A, a nozzle body 102' and a manifold 104' are depicted. The nozzle body 102' and the manifold 104' are similarly constructed as the nozzle body 102 and the manifold 104 of FIGS. 1A-1C. As described in further detail herein, the nozzle body 102' of FIGS. 2A and 2B has a different arrangement of cooling channels, and thus a partially different exterior shape, than that of the nozzle body 102 of FIGS. 1A-1C.

With particular reference to FIG. 2B, a cross-sectional view of the nozzle body 102' and the manifold 104' of FIG. 2A is depicted. The nozzle body 102' forms a spout 108' toward an end, from which a beverage is dispensed. The nozzle body 102' is configured to house a diffuser (e.g., the diffuser 110), which is held in place in the nozzle body 102' by the manifold 104'. As partially depicted in FIG. 2B, and as described in further detail herein, the nozzle body 102' also includes one or more cooling channels 112' defined therein. As also depicted in FIG. 2B, the nozzle body 102' defines a diffuser chamber 118', a mixing chamber 120', a dispensing channel 122', and an outlet 124'. The diffuser chamber 118' is configured to receive a diffuser, described in further detail herein. As also described in further detail herein, the manifold 104' is mountable to the nozzle body 102' to retain a diffuser within the diffuser chamber 118' of the nozzle body 102'.

Figure 3B:
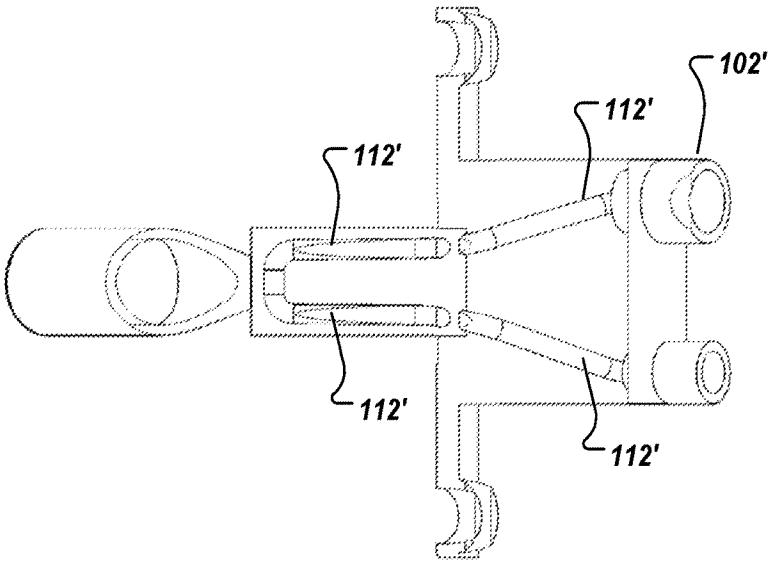
FIGS. 3A-3C depict respective views of an example nozzle body of a beverage dispensing nozzle assembly in accordance with implementations of the present disclosure.
Figure 3A:
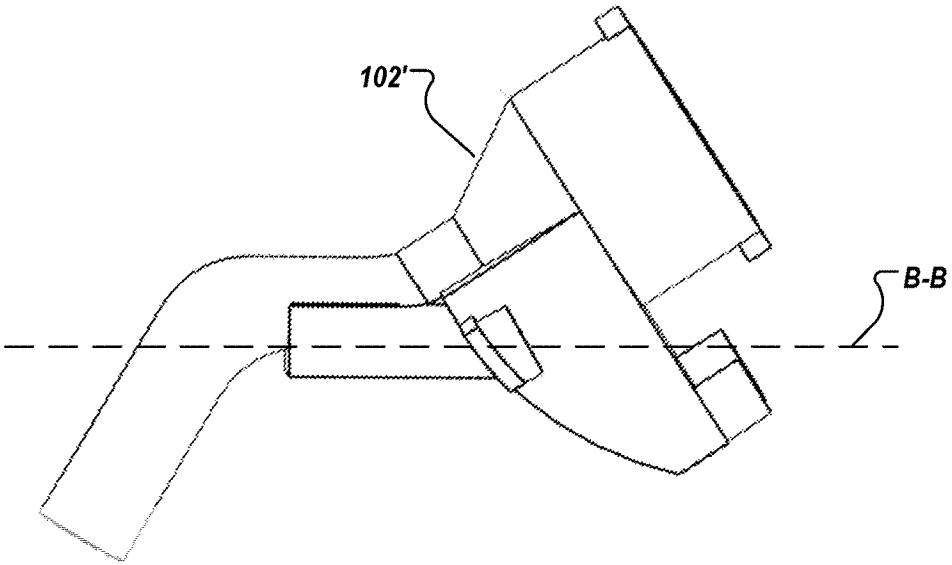
Figure 3C:
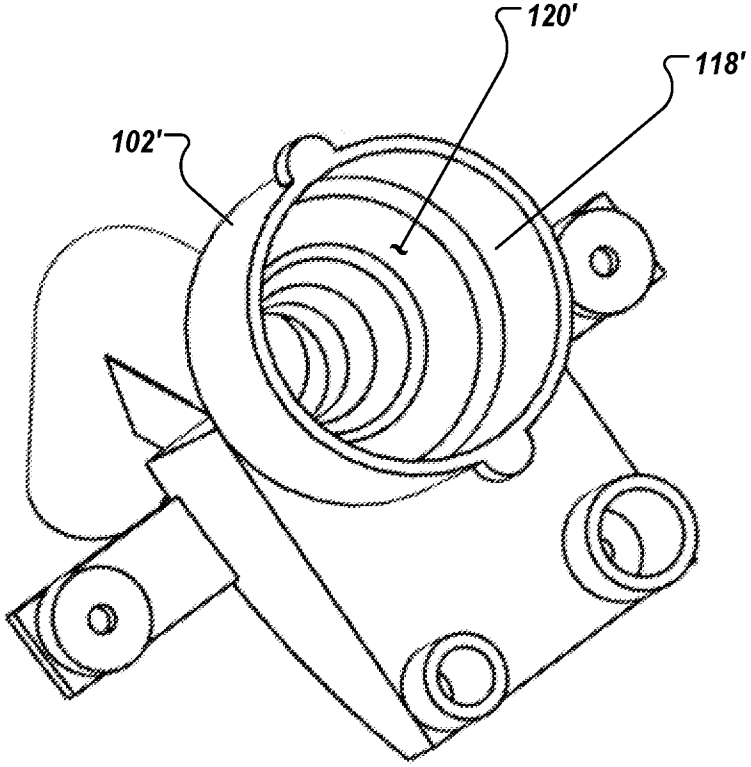

FIGS. 3A-3C depict respective views of the nozzle body 102' of FIGS. 2A and 2B. With particular reference to FIG. 3B, a cross-sectional view of a portion of the nozzle body 102' is depicted. The cross-sectional view is taken across a section line B-B of FIG. 3A. In the depicted example, multiple cooling channels 112' are formed in the nozzle body 102' and interconnect to form a cooling loop, such that cooling fluid (e.g., glycol) enters the nozzle body 102' through one of the cooling channels 112' and exits the nozzle body 102' from another of the cooling channels 112'. FIG. 3C depicts a perspective view of the nozzle body 102', in which the diffuser chamber 118' and the mixing chamber 120' are depicted.

Figure 4:
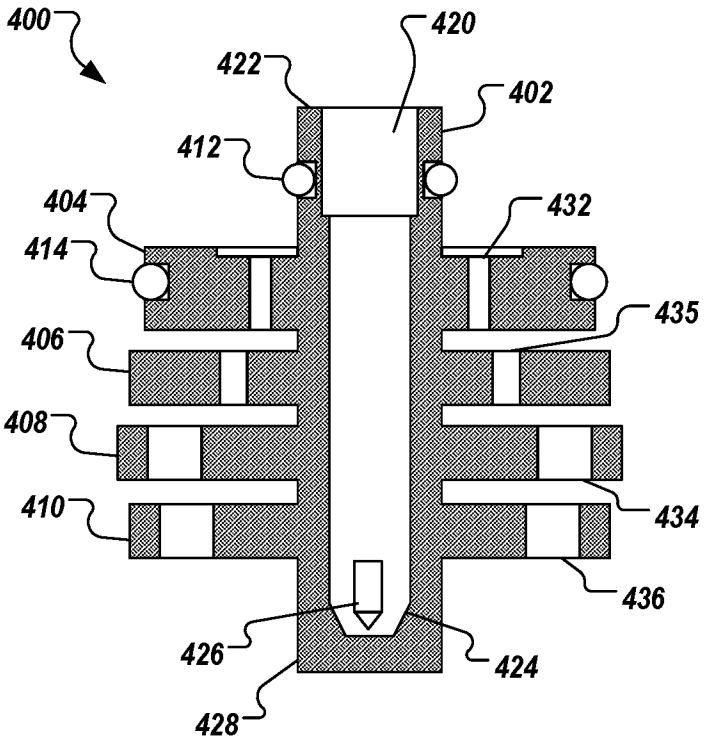
FIG. 4 depicts a cross-sectional view of an example diffuser in accordance with implementations of the present disclosure.

FIG. 4 depicts a cross-sectional view of an example diffuser 400 in accordance with implementations of the present disclosure. The example diffuser 400 is the same as or is similar to the diffuser 110 of FIGS. 1A-1C.

In the example of FIG. 4, the diffuser 400 includes a central body 402 formed as a cylinder and having discs 404, 406, 408, 410 formed therearound. A seal 412 is seated around the central body 402 and a seal 414 is seated around the disc 400. The seals 412, 414 can be provided as o-rings made from a sealing material (e.g., rubber) and seat and seal the diffuser 400 within the manifold 104, 104'. In the depicted example, the discs 404, 406, 408, 410 each have a cylindrical shape with generally flat upper and lower surfaces. In the some examples, one or more discs can be of a generally cylindrical shape, but be formed to include a tapered upper surface and/or a tapered lower surface. In some examples, a diameter of the disc 404 is less than a diameter of the disc 406, the diameter of the disc 406 is less than a diameter of the disc 408, and the diameter of the disc 408 is greater than a diameter of the disc 410. In other words, the discs 404, 406, 408 have increasingly larger diameters moving from the top-to-bottom as depicted in FIG. 4.

In the depicted example, the central body 402 includes an interior 420 running from an inlet end 422 to an outlet end 424. The outlet end 424 includes outlet openings 426 and fins 428. The interior 420 functions as a fluid conduit for concentrate, as described in further detail herein, such that concentrate flows through the outlet openings 426 into the mixing chamber 120, 120'.

In the example of FIG. 4, the disc 404 has passages 432 formed therethrough, the disc 406 has passages 435 formed therethrough, the disc 408 has passages 434 formed therethrough, and the disc 410 has passages 436 formed therethrough. In some examples, each of the passages 432 has a smaller diameter than each of the passages 435. In some examples, each of the passages 435 has a smaller diameter than each of the passages 434. In some examples, each of the passages 434 has a smaller diameter than each of the passages 436. In some examples, the disc 404 has a first number of the passages 432, the disc 406 has a second number of the passages 435, the disc 408 has a third number of the passages 434, and the disc 410 has a fourth number of the passages 436. In some examples, the first number is less than the second number, the second number is less than the third number, and the third number is less than the fourth number. In other words, the disc 404 has the fewest number of passages formed therethrough, and the disc 410 has the largest number of passages formed therethrough.

Figure 6:
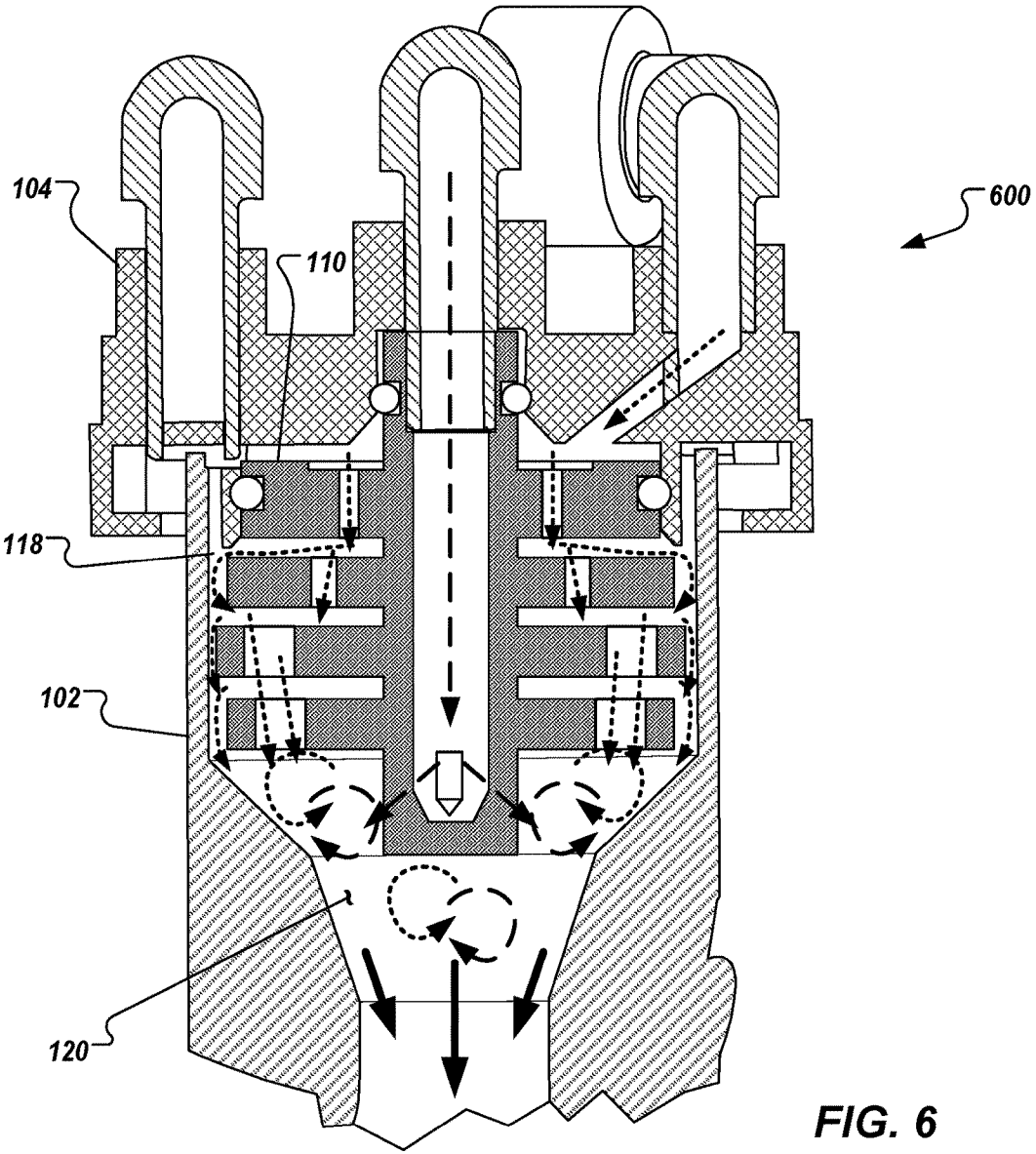
FIG. 6 depicts a cross-sectional view of a portion of the beverage dispensing nozzle assembly of the present disclosure.

Fluid flow around and trough the diffuser 110, 400 is described in further detail herein with reference to FIG. 6.

Figure 5B:
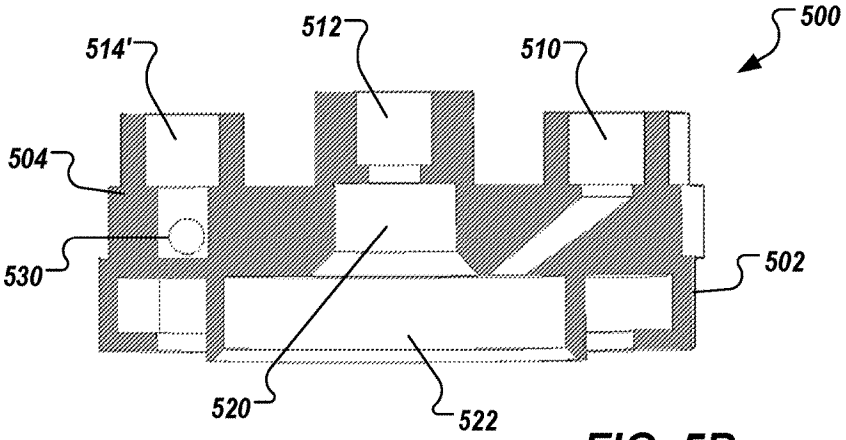
FIGS. 5A-5C depict respective views of a manifold in accordance with implementations of the present disclosure.
Figure 5C:
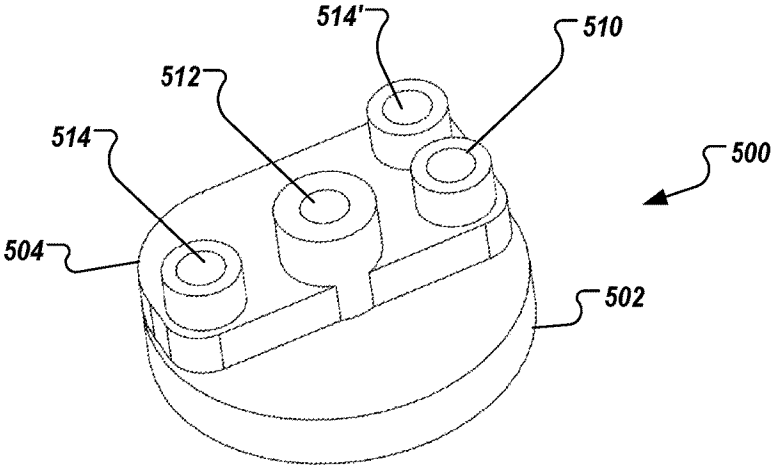
Figure 5A:
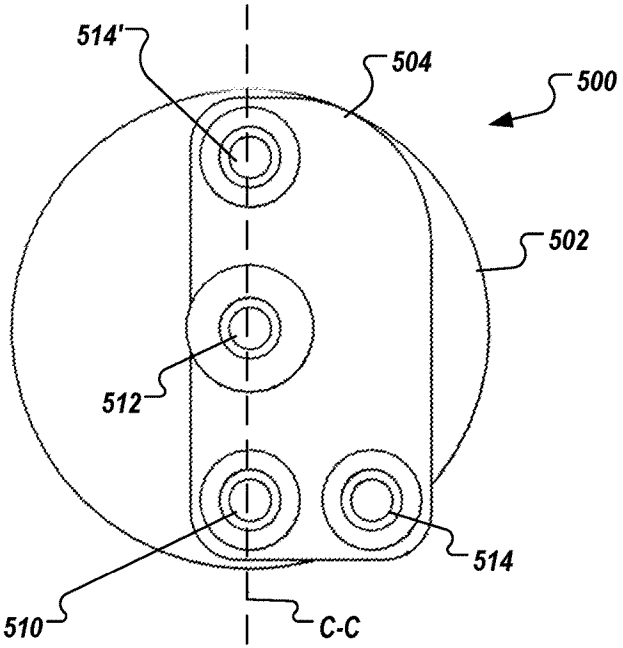

FIGS. 5A-5C depict respective views of an example manifold 500 in accordance with implementations of the present disclosure. The example manifold 500 is the same as or is similar to the manifold 104, 104' of FIGS. 1A-1C and FIGS. 2A and 2B, respectively.

In the example of FIGS. 5A-5C, the manifold 500 includes a lower body 502 and an upper body 504. In some examples, the lower body 502 and the upper body 504 are formed as a single body. That is, the manifold 500 is formed as a single component. In the depicted example, the manifold 500 includes an inlet 510 formed therein, an inlet 512 formed therein, and an inlet 514 and an outlet 514' formed therein. The inlet 510 receives a flow of a base fluid (e.g., gasified water) and channels the base fluid to the diffuser 110, 400. In some examples, the inlet 510 receives the flow of the base fluid from the base fluid source system 152 of FIG. 1A at the fourth flow rate ($f_{base,4}$). The inlet 512 receives a flow of a concentrate (e.g., HGB, UHGB) and channels the concentrate into the interior 420 of the diffuser 110, 420. In some examples, the inlet 510 receives the flow of the concentrate from the concentrate source system 150 of FIG. 1A at the fourth flow rate ($f_{con,4}$).

In some examples, the inlet 514 receives a flow of cooling fluid (e.g., glycol) into the manifold 500, and the outlet 514' exhausts the flow of cooling fluid from the manifold 500. One or more cooling channels 530 are formed within the manifold 500 to enable the cooling fluid to flow from the inlet 514 to the outlet 514'. In this manner, the manifold 500, and thus the base fluid flowing therethrough, is cooled. It is contemplated that the inlet 514 and the outlet 514' are interchangeable. In accordance with implementations of the present disclosure, the cooling fluid flowing through the cooling channel(s) maintains each of the base fluid and the concentrate at (or substantially at) a target temperature. As described above with example reference to beer, a target temperature for the beverage can depend on the type of the beverage. In some examples, a flow rate of the cooling fluid through the cooling channels is controlled to achieve the target temperature.

As depicted in FIG. 5B, which is a cross-sectional view taken across a section line C-C of FIG. 5A, the manifold 500 includes a chamber 520 and a chamber 522 formed therein. The chambers 520, 522 receive respective portions of the diffuser 110, 400 to seat and retain the diffuser 110, 400 therein. This is depicted in detail in FIGS. 1B and 6.

In some implementations, the cooling channels 112, 112' of the nozzle body 102, 102' and the cooling channels 530 of the manifold 104, 104' defining independent cooling paths within the nozzle assembly 100, 100'. That is, within the nozzle assembly 100, 100', cooling fluid flowing through the cooling channels 112, 112' of the nozzle body 102, 102' is blocked from flowing through the cooling channels 530 of the manifold 104, 104'. Likewise, within the nozzle assembly 100, 100', cooling fluid flowing through the cooling channels 530 of the manifold 104, 104' is blocked from flowing through the cooling channels 112, 112' of the nozzle body 102, 102'.

FIG. 6 depicts a cross-sectional view of a portion 600 of the beverage dispensing nozzle assembly 100 of the present disclosure. In FIG. 6, respective portions of each of the nozzle body 102, the manifold 104, and the diffuser 110 of FIGS. 1A-1C are depicted. In the example of FIG. 6, flow of the concentrate is represented as arrows with large dashed lines, flow of the base fluid is represented as arrows with small dashed lines, and flow of a reconstituted beverage is depicted as arrows with solid lines.

As depicted in FIG. 6, the concentrate flows through the manifold 104 through the inlet end 422 into the interior 420 of the diffuser 110 and exhausts from the diffuser 110 through the outlet end 424 through the outlet openings 426 into the mixing chamber 120. As also depicted in FIG. 6, base fluid flows through the manifold 104 to the top of the diffuser 110. Base fluid flows through the openings 430 of the disc 404 and is directed through the passages 435 and around the disc 406 to pass between the disc 404 and an interior wall of the nozzle body 102. Base fluid flows into a space between the disc 406 and the disc 408. A portion of base fluid flows through the openings 432 of the disc 408 and a portion of base fluid flows around the disc 408 to pass between the disc 408 and the interior wall of the nozzle body 102. Base fluid flows into a space between the disc 408 and the disc 410. A portion of base fluid flows through the openings 436 of the disc 410 and a portion of base fluid flows around the disc 410 to pass between the disc 410 and the interior wall of the nozzle body 102.

After the disc 410, the base fluid and the concentrate meet within the mixing chamber 120. As depicted in FIG. 6, the base fluid enters the mixing chamber 120 from the diffuser 110 in various directions to impinge upon the inflowing concentrate. Similarly, the concentrate enters the mixing chamber 120 from the diffuser in various directions. In this manner, mixing of the concentrate and the base fluid is induced within the mixing chamber 120 to produce the reconstituted beverage. That is, mixing of the concentrate and the base fluid is substantially within the mixing chamber 120. In some examples, substantially within the mixing chamber 120 means that a majority of the mixing occurs in the mixing chamber 120. In some examples, substantially within the mixing chamber 120 means that a threshold proportion of mixing occurs in the mixing chamber 120. In some examples, substantially within the mixing chamber 120 means that all of the mixing occurs in the mixing chamber 120.

In some examples, a pressure within the mixing chamber is atmospheric pressure (e.g., 1 ATM, 101325 Pa, 1.01325 bar, at sea level) or is substantially atmospheric pressure (e.g., although not exactly atmospheric pressure within a small degree of atmospheric pressure).

Figure 7:
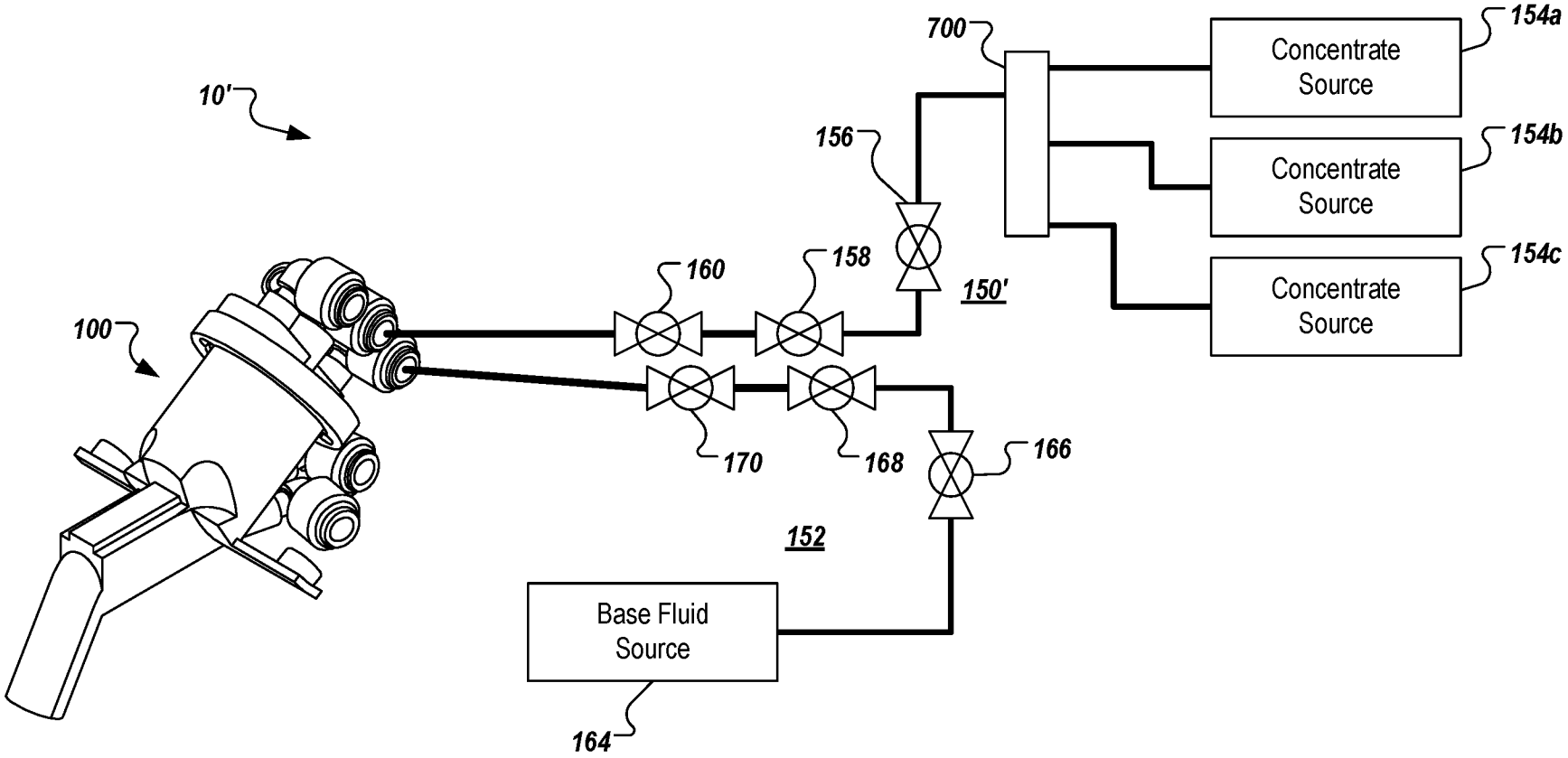
FIG. 7 depicts a beverage dispensing system in accordance with implementations of the present disclosure.

FIG. 7 depicts a beverage dispensing system 10', which includes the nozzle assembly 100, a concentrate source system 150', and the base fluid source system 152. Although not depicted in FIG. 7, it is contemplated that the beverage dispensing system 10' can include the cooling system 180 and the control system 190 (with the one or more sensors 192). In the example of FIG. 7, the concentrate source system 150' includes a manifold 700, a concentrate source 154*a*, a concentrate source 154*b*, and a concentrate source 154*c*. In some examples, each concentrate source 154*a*, 154*b*, 154*c* retains a respective type of beverage (e.g., type of beer). In some examples, a beverage that is to be dispensed from the beverage dispensing system 10' can be selected and flow of a respective concentrate from one of the concentrate sources 154*a*, 154*b*, 154*c* can be enabled through the manifold 700. For example, the manifold 700 can include a valve system that enables flow through the manifold 700 from only one of the concentrate source 154*a*, the concentrate source 154*b*, and the concentrate source 154*c*. In some examples, a setting of the first valve 156 and/or the first valve 166 can be adjusted to provide a In accordance with implementations of the present disclosure, and as described herein, the beverage dispensing system of the present disclosure provides for dispensing of post-mixed beverages with in-nozzle mixing to achieve a set of standards for the respective beverage. More particularly, the valve system provides for flow of each of the base fluid and the concentrate at a reduced flow rate and at a predetermined mix ratio. The cooling fluid flowing through the cooling channels in each of the nozzle body 102 and the manifold 104 maintains each of the base fluid, the concentrate, and the (reconstituted) beverage at (or substantially at) a target temperature.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

What is claimed is:

1. A beverage dispensing system, comprising:

a nozzle assembly comprising:

a nozzle body having a diffuser chamber, a mixing chamber, and one or more cooling channels formed therein, a diffuser disposed within the diffuser chamber and being fixed from movement within the nozzle body during operation of the beverage dispensing system, and a manifold having one or more cooling channels formed therein and being configured to receive a flow of a base fluid and a flow of a concentrate for mixing of the base fluid and the concentrate in the mixing chamber to provide a beverage; and a valve system comprising one or more valves for regulating respective flow rates of each of the base fluid and the concentrate to substantially achieve a target mix ratio of the base fluid to concentrate within the mixing chamber.

2. The beverage dispensing system of claim 1, wherein at least one valve of the one or more valves is adjustable to adjust a mix ratio of the beverage to substantially achieve the target mix ratio.

3. The beverage dispensing system of claim 1, wherein the diffuser is retained within the diffuser chamber by the manifold.

4. The beverage dispensing system of claim 1, wherein at least a portion of the diffuser extends into the mixing chamber.

5. The beverage dispensing system of claim 1, wherein the flow of concentrate travels through an interior of the diffuser and at least a portion of the flow of the base fluid travels around the diffuser for mixing of the base fluid and the concentrate substantially within the mixing chamber.

6. The beverage dispensing system of claim 1, wherein the valve system comprises an on/off valve for each of the concentrate and the base fluid.

7. The beverage dispensing system of claim 1, wherein the target mix ratio is specific to the beverage dispensed from the dispensing system.

8. The beverage dispensing system of claim 1, wherein the concentrate comprises a beer concentrate and the base fluid comprises one of carbonated water and nitrogenated water.

9. The beverage dispensing system of claim 1, wherein a concentrate source system comprises a manifold that the concentrate flows through.

10. The beverage dispensing system of claim 9, wherein the concentrate is one of multiple concentrates that can selectively flow through the manifold within the concentrate source system.

11. A beverage dispensing system, comprising:

a nozzle assembly comprising:

a nozzle body having a mixing chamber and one or more first cooling channels formed therein, a diffuser at least partially disposed within nozzle body and being fixed from movement within the nozzle body during operation of the beverage dispensing system, and a manifold having one or more second cooling channels formed therein and being configured to receive a flow of a base fluid and a flow of a concentrate for mixing of the base fluid and the concentrate in the mixing chamber to provide a beverage, the one or more first cooling channels of the nozzle body and the one or more second cooling channels of the manifold defining independent cooling paths within the nozzle assembly; and a valve system comprising one or more valves for regulating respective flow rates of each of the base fluid and the concentrate to substantially achieve a target mix ratio of the base fluid to concentrate within the mixing chamber.

12. The beverage dispensing system of claim 11, wherein at least one valve of the one or more valves is adjustable to adjust a mix ratio of the beverage to substantially achieve the target mix ratio.

13. The beverage dispensing system of claim 11, wherein the diffuser is retained within a diffuser chamber by the manifold.

14. The beverage dispensing system of claim 11, wherein at least a portion of the diffuser extends into the mixing chamber.

15. The beverage dispensing system of claim 11, wherein the flow of concentrate travels through an interior of the diffuser and at least a portion of the flow of the base fluid travels around the diffuser for mixing of the base fluid and the concentrate substantially within the mixing chamber.

16. The beverage dispensing system of claim 11, wherein the valve system comprises an on/off valve for each of the concentrate and the base fluid.

17. The beverage dispensing system of claim 11, wherein the target mix ratio is specific to the beverage dispensed from the dispensing system.

18. The beverage dispensing system of claim 11, wherein the concentrate comprises a beer concentrate and the base fluid comprises one of carbonated water and nitrogenated water.

19. The beverage dispensing system of claim 11, wherein a concentrate source system comprises a manifold that the concentrate flows through.

20. The beverage dispensing system of claim 19, wherein the concentrate is one of multiple concentrates that can selectively flow through the manifold within the concentrate source system.

* * * * *